United States Patent [19]

Sasaki et al.

[11] Patent Number: 4,892,168

[45] Date of Patent: Jan. 9, 1990

[54] NOISE ATTENUATING DEVICE

[75] Inventors: Akira Sasaki; Yuichi Sakuma, both of Yokosuka, Japan

[73] Assignee: Nissan Motor Co., Ltd., Yokohama, Japan

[21] Appl. No.: 286,750

[22] Filed: Dec. 20, 1988

[30] Foreign Application Priority Data

Dec. 22, 1987 [JP] Japan ..... 62-194282
Apr. 26, 1988 [JP] Japan ..... 63-103566

[51] Int. Cl.[4] ..... F01N 1/02

[52] U.S. Cl. ..... 181/250; 181/273; 181/276

[58] Field of Search ..... 60/312; 181/250, 273, 181/276

[56] References Cited

U.S. PATENT DOCUMENTS 2,765,044 10/1956 Hatte ..... 181/275
4,415,059 11/1983 Hayashi ..... 181/250

FOREIGN PATENT DOCUMENTS 343640 10/1936 Italy ..... 181/273
57-31517 7/1982 Japan .
58-106514 7/1983 Japan .
121212 12/1918 United Kingdom ..... 181/273

*Primary Examiner*—Douglas Hart
*Attorney, Agent, or Firm*—Lowe, Price, LeBlanc, Becker & Shur

[57] ABSTRACT

A resonator used in an exhaust system of an automotive internal combustion engine. The resonator defines therein a resonance chamber and provided with an exhaust gas inlet tube through which exhaust gas is introduced into the resonator. An exhaust gas outlet tube is provided so that exhaust gas is discharged out of the resonator through the outlet tube. The inside ends of the inlet and outlet tubes are connected with a tuning tube respectively at positions which are opposite to each other with respect to the axis of the tuning tube. The opposite ends of the tuning tube are opened to the resonance chamber. The inner diameter of the tuning tube is larger than that of the inlet tube and that of the outlet tube, thereby greatly improving noise attenuating effects under resonance as compared with conventional resonators.

11 Claims, 4 Drawing Sheets

NOISE ATTENUATING DEVICE

BACKGROUND OF THE INVENTION

1. Field of the Invention

This invention relates generally to improvements in a noise attenuating device functioning under resonance, and more particularly to a resonator used in an exhaust system of an automotive internal combustion engine.

2. Description of the Prior Art

Automotive vehicles are equipped with a resonator in an exhaust system in order to attenuate exhaust noise under effect of resonance. Hitherto a variety of resonators have been proposed and put into practical use. One of them is constructed as follows: An exhaust gas introduction tube is disposed to pass through a main body of the resonator. A resonance chamber is defined within the main body. A tuning tube is connected at its one end with the exhaust gas introduction tube to establish communication of the inside of the introduction tube with the resonance chamber. With this arrangement, exhaust noise is attenuated under effect of a resonator arrangement including the resonance chamber and the tuning tube.

However, the following difficulties have been encountered in the above arranged resonator: The tuning tube is usually connected at its one end with the exhaust gas introduction tube, and therefore it is difficult to enlarge the inner diameter of the tuning tube over that of the exhaust gas introduction tube. This unavoidably suppresses the noise attenuating effect of the resonator, which has been confirmed by experiments. Additionally, such a cantilever-type support for the tuning tube causes stress to concentrate at the joint section of the tuning tube with the exhaust gas introduction tube. Accordingly, the tuning tube is liable to be broken.

SUMMARY OF THE INVENTION

An object of the present invention is to provide an improved noise attenuating device which is higher in noise attenuating effect under resonance than conventional devices.

Another object of the present invention is to provide an improved noise attenuating device in which a tuning tube is larger in inner diameter than a gas introduction tube through which the gas to the noise-attenuated device passes.

A further object of the present invention is to provide an improved resonator used in an exhaust system of an internal combustion engine, in which a tuning tube opened to a resonance chamber is larger in inner diameter than an exhaust gas introduction tube through which exhaust gas passes.

According to the present invention, a noise attenuating device is comprised of a main body defining therein a resonance chamber. A gas inlet tube extends into the inside of the main body so that gas is introduced through the inlet tube inside the main body. A gas outlet tube extends into the inside of the main body so that gas inside the main body is dischaged through the outlet tube into the outside of the main body. Additionally, a tuning tube is provided in such a manner that the inlet and outlet tubes are connected with the tuning tube. The tuning tube is located between the inlet and outlet tubes so that gas from the inlet tube flows through the tuning tube into the outlet tube. The tuning tube is opened to the resonance chamber so as to establish gas communication between the inside of the tuning tube and the resonance chamber. The cross-sectional area defined by the inner periphery of the tuning tube is larger than that of the inlet tube and that of the outlet tube.

By virtue of the tuning pipe larger in inner diameter than the gas introduction tube, the noise attenuating device is greatly improved in noise attenuating effect over conventional similar noise attenuating devices of the resonator type having the same resonator volume. Additionally, the tuning pipe is interposed between the inlet and outlet tubes and therefore is stably and securely supported, thereby preventing the breakage of the tuning tube.

BRIEF DESCRIPTION OF DRAWINGS

In the drawings, like reference numerals designate corresponding elements and parts, in which.

DETAILED DESCRIPTION OF THE INVENTION

Figure 1:
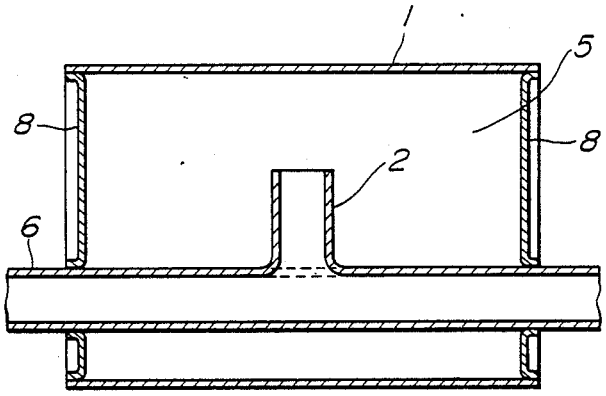
FIG. 1 PRIOR ART
FIG. 1 is a longitudinal sectional view of a conventional noise attenuating device.

To facilitate understanding of the present invention, a brief reference will be made to conventional automotive resonators, depicted in FIGS. 1 and 2. Referring to FIG. 1, a conventional so-called Helmholtz type resonator or muffler is shown having a main body 1 defining therein a resonance chamber 5. An exhaust gas introduction tube 6 extends through the resonance chamber 5, piercing opposite end plates 8, 8. Additionally, a tuning tube 2 is connected with the exhaust gas introduction tube 6 so that the inside of the tube 6 is in communication with the resonance chamber 5, thus attenuating exhaust noise at a particular frequency.

Such a particular frequency is so-called resonance frequency (f) which is obtained by the following equation:

$$f = \frac{C}{2\pi} \frac{S}{Vl}$$

where l is the length of the tuning tube 2; S is the cross-sectional area defined by the inner periphery of the tuning tube 2; V is the volume of the resonance chamber 5; and C is sound velocity.

Figure 2:
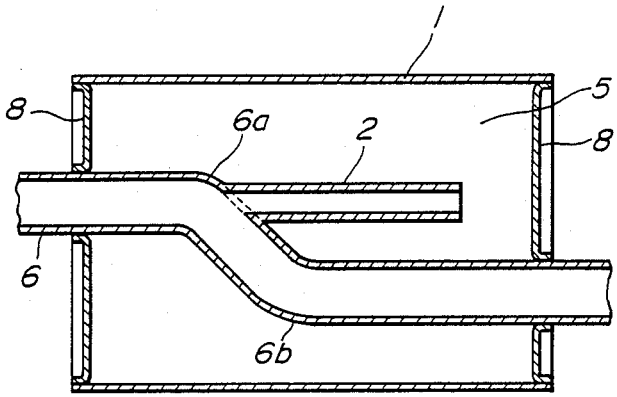
FIG. 2 PRIOR ART
FIG. 2 is a longitudinal sectional view of another conventional noise attenuating device.

Referring to FIG. 2, another conventional resonator or muffler is shown in which the exhaust gas introduction tube 6 has upper and lower bent portions 6a, 6b. The tuning pipe 2 is connected with the exhaust gas introduction tube 6 at the upper bent portion 6a in such a manner that the axis of the tuning pipe 2 is aligned with the axis of the exhaust gas introduction tube 6 upstream of the upper bent portion 6a. With this arrangement, the tuning tube 2 is disposed so as to be aligned with the flow direction of exhaust gas, and therefore the resonator is higher in noise attenuation effect than that shown in FIG. 1. Such an arrangement is disclosed, for example, in Japanese Utility Model Provisional Publication No. 58-106514.

However, in the above-discussed resonator, the turning tube 2 is connected with the exhaust gas introduction tube 6 and therefore the diameter of the tuning tube 2 cannot be enlarged over that of the exhaust gas introduction tube 6. As a result, there is a limit to improved noise attenuating ability and tuning of frequency. Additionally, since the tuning tube 2 is supported at its one end, stress tends to be concentrated at the joint section of the tuning tube 2 with the exhaust gas introduction tube 6 thereby causing breakage of the tuning pipe 2 in case the tuning tube 2 is longer. Furthermore, if the tuning tube 2 having a relatively large diameter is connected with the exhaust gas introduction tube 6, a considerable part of the tuning tube 2 unavoidably projects into the inside of the exhaust gas introduction tube 6, so that the projecting part serves as an obstacle for flow of exhaust gas passing through the exhaust gas introduction tube 6 thereby unavoidably increasing flow resistance of exhaust gas. Accordingly, the diameter of the tuning pipe 2 is unavoidably suppressed to be about ½ of that of the exhaust gas introduction tube 6. Concerning the above-discussed arrangement in which the tuning tube 2 has a considerable part projecting into the exhaust gas introduction tube 6, it is possible to cut out the projecting part; however, such cutting step complicates the production process of the resonator while increasing production costs of the resonator.

Figure 3:
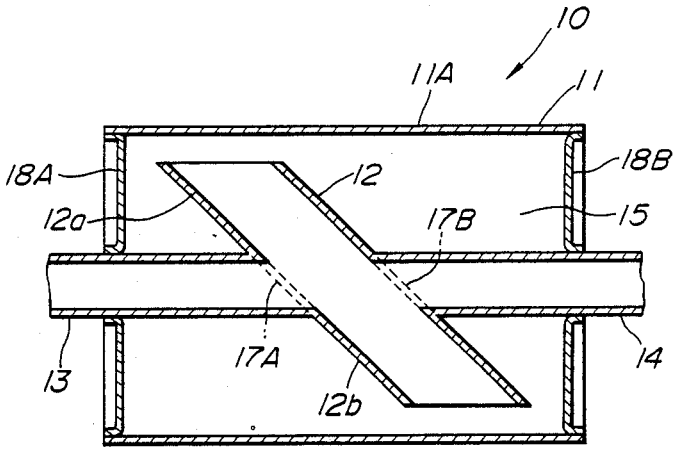
FIG. 3 is a longitudinal sectional view of a first embodiment of a noise attenuating device in accordance with the present invention.

In view of the above description of the conventional resonators, reference is now made to FIGS. 3 to 8, and more specifically to FIG. 3, wherein a first embodiment of the noise attenuating device or resonator is illustrated by the reference numeral 10. The resonator 10 of this embodiment is used for an exhaust system of an automotive internal combustion engine and comprises a main body or casing 11 including a generally cylindrical member 11A. A pair of generally annular end plates 8A, 8B are disposed in spaced relationship from each other and connected to the opposite open ends of the cylindrical member 11A, thereby defining a resonance chamber 15. An exhaust gas inlet tube 13 is fitted in a central hole (not identified) of the end plate 18A and extends into the resonance chamber 5 so that exhaust gas from the engine is introduced into the inside of the resonator 10. An exhaust gas outlet tube 14 is fitted in a central hole (not identified) of the end plate 18B so that exhaust gas inside the resonator 10 is discharged out of the resonator 10. As shown in FIG. 3, the inlet and outlet tubes 13, 14 are aligned with each other.

The inlet tube 3 has an inside end (no numeral) connected with a tuning tube 12 at a central portion so that the inside of the outlet tube 14 is in communication with the inside of the tuning tube 12 through a central hole 17A of the tuning tube 12. The outlet tube 14 has an inside end (no numeral) connected with the tuning tube 12 at the central portion so that the inside of the outlet tube 3 is in communication with the inside of the tuning tube 12 through another central hole 17B of the tuning tube 12. The inner diameter of the tuning tube 12 is larger than that of the inlet or outlet tube 13, 14. In other words, the cross-sectional area of the inside opening of the tuning tube 12 is larger than that of the inlet or outlet tube 13, 14. The inside ends of the inlet and outlet tubes 13, 14 are opposite to each other with respect to the tuning tube 12. The tuning tube 12 is straight and elongated and has opposite ends opened to the resonance chamber 15. In this embodiment, the axis of the tuning tube 12 crosses and inclines relative to the axis of the inlet and outlet tube 13, 14. Accordingly, the inside of the inlet tube 13, the tuning tube 12 and the outlet tube 14 is in communication with the resonance chamber 15. The tuning tube 12 has an upper section 12a extending upward from the central section thereof, and a lower section 12b extending downward from the central section thereof. The axis of the upper section 12a crosses the axis of the inlet tube 13 forming an acute angle while crossing the axis of the outlet tube 14 forming an obtuse angle. The axis of the lower section 12b crosses the axis of the inlet tube 13 forming an obtuse angle while crossing the axis of the outlet tube 14 forming an acute angle.

With the thus arranged resonator 10, exhaust gas from the engine flows through the inlet tube 13 to the outlet tube 4 to be discharged out of the resonator 10, in which a resonator arrangement is constitued by the upper and lower sections 12a, 12b of the tuning tube 12 thereby exhibiting a noise attenuating effect.

Figure 4:
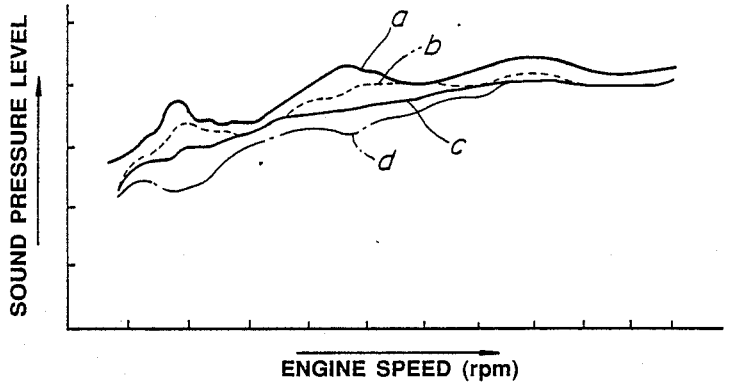
FIG. 4 is a graph showing the experimental data of the conventional noise attenuating device of FIG. 1, in which sound pressure level was measured upon varying the inner diameter and the length of a tuning tube.
Figure 5:
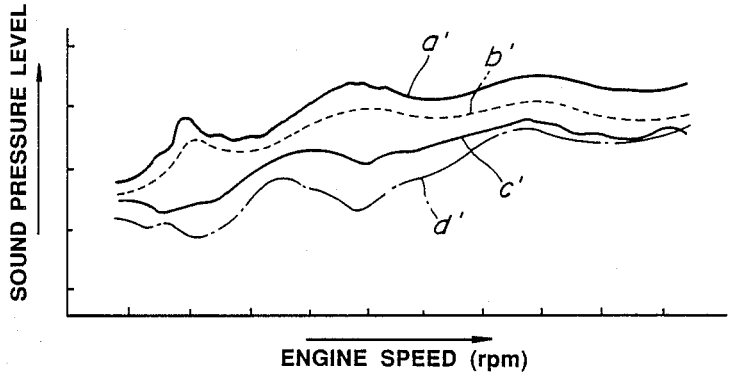
FIG. 5 is a graph showing the experimental data of the conventional noise attenuating device of FIG. 2, in which sound pressure level was measured upon varying the inner diameter and the length of a tuning tube.

Now reference is made to FIGS. 4 and 5 which show measured sound pressure levels of the conventional resonators shown in FIGS. 1 and 2, respectively, for the purpose of comparing noise attenuating effects with respect to the second harmonics of engine revolution. In FIG. 4, line a indicates sound pressure level of a case in which only the exhaust gas introduction tube 6 was used without using the tuning tube 2 in FIG. 1; and lines b, c and d indicate sound pressure levels in cases (FIG. 1) in which the tuning tube 2 was used to be connected with the exhaust gas introduction tube 6, in which the inner diameter and the length of the tuning tube 2 increased in the order of b, c and d (or $b<c<d$). In FIG. 5, a line a' indicates sound pressure, level in a case in which only the exhaust gas introduction tube 6 was used without using the tuning tube 2 in FIG. 2; and lines b', c' and d' indicate sound pressure levels in cases (FIG. 2) in which the tuning tube 2 was used to be connected with the exhaust gas introduction tube 6, in which the inner diameter and the length of the tuning tube 2 increased in the order of b', c' and d' (or $b'<c'<d'$).

The graphs, of FIGS. 4 and 5 reveal that there is a tendency for the noise attenuating effect to be improved when the inner diameter and the length of the tuning tube are larger in case the inner diameter and the length of the tuning tube 2 is set to obtain the same tuning frequency under a condition in which the volume of the resonance chamber is constant.

In this regard, according to the present invention, the inner diameter of the tuning tube 12 is larger than that of the inlet or outlet tubes 13, 14 to greatly improve the noise attenuating effect. This is accomplished by the arrangement in which the inlet and outlet tubes 13, 14 are connected with the tuning tube 12.

Additionally, in the arrangement according to the present invention, the tuning pipe 12 is supported at the opposite two portions and therefore not in a so-called cantilever manner. Accordingly, even if the tuning tube 12 is set longer, a special support member for the tuning pipe 12 is not necessary for preventing stress from concentrating at a joint section of the tuning tube 12 with the inlet and outlet tubes 13, 14, thus improving durability of the resonator 10.

It will be understood that the angle of the axis of the tuning tube 12 relative to the axis of the inlet and outlet tubes 13, 14 is freely selectable, and therefore such an angle can be set at an optimum value to exhibit a greater noise attenuating effect relative to flow of exhaust gas.

Furthermore, since the inlet and outlet tubes 13, 14 are connected with the tuning tube 2, the diameter of the tuning tube 12 can be increased, so that exhaust gas flow resistance cannot increase even if there is a projecting part of the inlet and outlet tubes 13, 14 protruding inside the tuning tube 12 in connection with joining of the inlet and outlet tubes 13, 14 with the tuning tube 12. Thus, even the projecting part does not affect exhaust gas flow and therefore no special machining is required thereby to simplify production process of the resonator.

Figure 6:
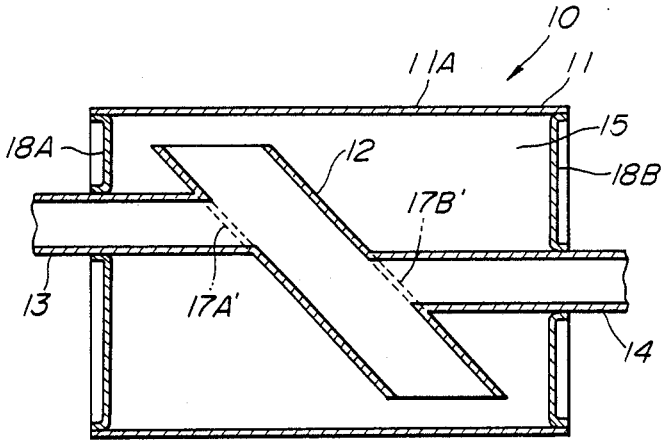
FIG. 6 is a longitudinal sectional view of a second embodiment of the noise attenuating device in accordance with the present invention.

FIG. 6 illustrates a second embodiment of the resonator or noise attenuating device in accordance with the present invention, which is similar to the first embodiment of FIG. 3 with the exception that the axes of the inlet and outlet tubes 13, 14 are not aligned with each other but are parallel with each other. In this embodiment, the inside end of the inlet tube 13 is connected with the tuning tube 12 at an upper section relative to the central section of the tuning tube 12, while the inside end of the outlet tube 14 is connected with the tuning tube 12 at a lower section relative to the central portion of the tuning tube 12. The inside of the inlet tube 13 is communicated with the hole 17A' with the inside of the tuning tube 12, while the inside of the outlet tube 14 is communicated through the hole 17B' with the inside of the tuning tube 12. Also in this embodiment, the inner diameter of the tuning tube 12 is larger than that of the inlet or outlet tube 13, 14.

With this arrangement, the axes of the inlet and outlet tubes 13, 14 are not aligned with each other, and therefore exhaust gas introduced through the inlet tube 13 can flow along the axis of the tuning tube 12, so that gas within the tuning tube 12 becomes liable to move. This enhances the noise attenuating effect caused by the resonator arrangement including the resonance chamber 15 and the tuning tube 12.

Figure 7:
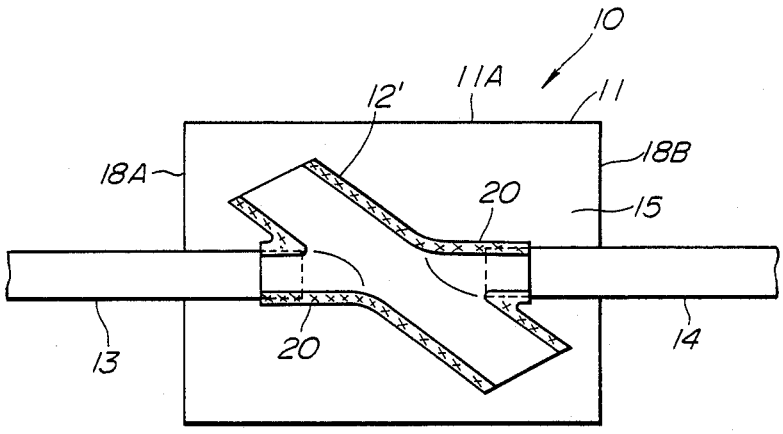
FIG. 7 is a longitudinal sectional view of a third embodiment of the noise attenuating device in accordance with the present invention.

FIG. 7 illustrates a third embodiment of the resonator according to the present invention, which is similar to the first embodiment of FIG. 3. In this embodiment, a tube structure 19 is provided to have a section 12' corresponding to the tuning tube and two opposite joint tube sections 20, 20. The tube structure 19 is constructed of two counterparts produced by press-forming or stamping a metal sheet. The counterparts are combined to obtain the tube structure 19. As shown, the inside ends of the inlet and outlet tubes 13, 14 are fitted in the opposite joint tube sections 20, 20, respectively. Also in this embodiment, the inner diameter of the tube section 12' is larger than that of the inlet or outlet tube 13, 14. It will be appreciated that such an arrangement facilitates production of the resonator while simplifying production process thereof.

Figure 8:
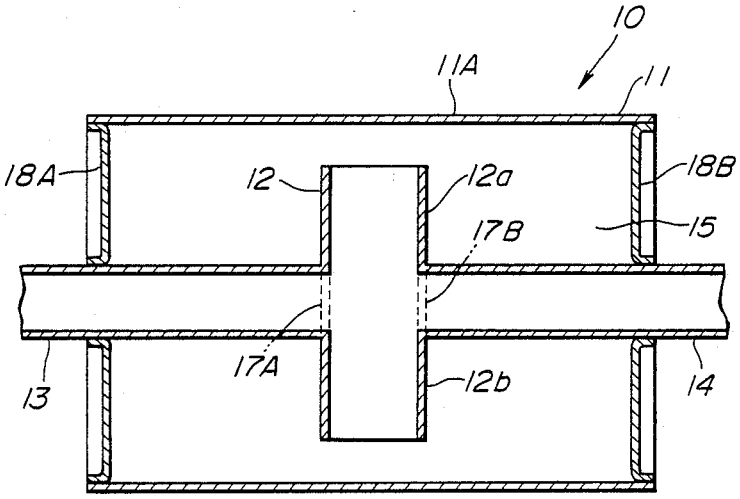
FIG. 8 is a longitudinal sectional view of a fourth embodiment of the noise attenuating device in accordance with the present invention.

FIG. 8 illustrates a fourth embodiment of the resonator according to the present invention, which is similar to the first embodiment with the exception that the axis of the tuning tube 12 is perpendicular to the axis of the inlet and outlet tubes 13, 14. Also in this embodiment, the inner diameter of the tuning tube 12 is larger than that of the inlet or outlet tube 13, 14. It will be appreciated that this arrangement exhibits the similar noise attenuating effect as in the first embodiment.

While the embodiments have been shown and described as resonators for an exhaust system of an internal combustion engine, it will be understood that the principle of the present invention will be applied to a resonator used in an intake system of an internal combustion engine in which air induction noise is attenuated or to other noise attenuating devices.

What is claimed is:

1. A noise attenuating device comprising:

a main body defining therein a resonance chamber;

a gas inlet tube extending to the inside of said main body so that gas is introduced through said inlet tube into the inside of said main body;

a gas outlet tube extending to the inside of said main body so that gas inside said main body is discharged through said outlet tube to the outside of said main body; and a tuning tube to which said inlet and outlet tubes are connected, said tuning tube being located between said inlet and outlet tubes so that gas from said inlet tube flows through said tuning tube into said outlet tube, said tuning tube being opened to the resonance chamber so as to establish gas communication between the inside of said tuning tube and the resonance chamber, the cross-sectional area defined by the inner periphery of said tuning tube being larger than that of said inlet tube and that of said outlet tube.

2. A noise attenuating device as claimed in claim 1, wherein said inlet tube has a first end located within the resonance chamber, and said outlet tube has a first end located within the resonance chamber, wherein said tuning tube has first and second holes which are disposed opposite to each other with respect to an axis of said tuning tube, said inlet tube first end being fixedly connected with said tuning tube at the first hole so that the inside of said inlet tube communicates through said first hole with the inside of said tuning tube, said outlet tube first end being fixedly connected with said tuning tube at the second hole so that the inside of said outlet tube communicates through said second hole with the inside of said tuning tube.

3. A noise attenuating device as claimed in claim 2, wherein said tuning tube axially extends to and has first and second ends which are opened to the resonance chamber.

4. A noise attenuating device as claimed in claim 3, wherein said first and second holes of said tuning tube are located at a central section of said tuning tube.

5. A noise attenuating device as claimed in claim 4, wherein the axes of said inlet and outlet tubes are aligned with each other.

6. A noise attenuating device as claimed in claim 4, wherein said first and second holes of said tuning tube are located opposite to each other with respect to a central section of said tuning tube.

7. A noise attenuating device as claimed in claim 6, wherein the axes of said inlet and outlet tubes are parallel with and separate from each other in longitudinal direction of the axis of said tuning tube.

8. A noise attenuating device as claimed in claim 2, wherein the axis of said tuning tube inclines relative to an axis perpendicular to the axis of said inlet tube and to the axis of said outlet tube.

9. A noise attenuating device as claimed in claim 2, wherein the axis of said tuning tube is perpendicular to the axis of said inlet tube and to the axis of said outlet tube.

10. A noise attenuating device as claimed in claim 1, wherein said main body includes a generally cylindrical member, and first and second end plates fixedly secured to opposite end sections of said cylindrical member to define the resonance chamber therebetween, wherein said inlet tube extends through said first end plate, and said outlet tube extends through said second end plate

11. A resonator in an exhaust system of an internal combustion engine, said resonator comprising:

a main body defining therein a resonance chamber;

an exhaust gas inlet tube connected to the engine and extending to the inside of said main body so that exhaust gas is introduced into the inside of said main body, said inlet tube having an inside end located inside said main body;

an exhaust gas outlet tube extending into the inside of said main body so that exhaust gas inside said main body is discharged through said outlet tube to outside of said main body, said outlet tube having an inside end located inside said main body; and a tuning tube having first and second holes which are located opposite to each other with respect to an axis of said tuning tube, the inside end of said inlet tube being rigidly connected with said tuning tube at the first hole, the inside end of said outlet tube being rigidly connected with said tuning tube at the second hole, said tuning tube having first and second ends opened to the resonance chamber so that the inside of said inlet and outlet tubes is in gas communication with the resonance chamber through said tuning tube, the cross-sectional area defined by the inner periphery of said tuning tube being larger than that of said inlet tube and that of said outlet tube.

* * * * *